US007694472B2

(12) United States Patent
Rawlings

(10) Patent No.: US 7,694,472 B2
(45) Date of Patent: Apr. 13, 2010

(54) MANUFACTURE OF THERMALLY INSULATED FRAME MEMBERS

(75) Inventor: David Rawlings, Bishops Cleeve (GB)

(73) Assignee: Architectural & Metal Systems Limited, County Cork (IE)

( * ) Notice: Subject to any disclaimer, the term of this patent is extended or adjusted under 35 U.S.C. 154(b) by 1083 days.

(21) Appl. No.: 10/504,420

(22) PCT Filed: Feb. 3, 2003

(86) PCT No.: PCT/GB03/00417

§ 371 (c)(1),
(2), (4) Date: Jan. 28, 2005

(87) PCT Pub. No.: WO03/069105

PCT Pub. Date: Aug. 21, 2003

(65) Prior Publication Data

US 2005/0115183 A1 Jun. 2, 2005

(30) Foreign Application Priority Data

Feb. 14, 2002 (IR) ..... 2002/0111

(51) Int. Cl.
*E04C 3/29* (2006.01)
*E04B 1/62* (2006.01)

(52) U.S. Cl. ..... 52/210; 52/213; 52/212; 52/216; 52/204.5; 52/204.1

(58) Field of Classification Search ..... 52/204.1, 52/210–212, 213, 216, 204.5, 204.56, 204.596, 52/582.1, 586.1, 586.2, 585.1
See application file for complete search history.

(56) References Cited

U.S. PATENT DOCUMENTS

| | | | | | |
|---|---|---|---|---|---|
| 2,834,999 | A | * | 5/1958 | Taylor | 52/172 |
| 3,492,770 | A | * | 2/1970 | Furner | 52/204.597 |
| 3,517,472 | A | * | 6/1970 | Toth | 52/204.591 |
| 3,818,666 | A | | 6/1974 | Winans | |
| 3,823,524 | A | * | 7/1974 | Weinstein | 52/717.02 |
| 4,194,284 | A | * | 3/1980 | Diels et al. | 29/509 |
| 4,226,063 | A | * | 10/1980 | Chenel | 52/172 |
| 4,342,144 | A | * | 8/1982 | Doguchi | 29/897.312 |
| 4,459,789 | A | * | 7/1984 | Ford | 52/656.5 |
| 5,216,810 | A | * | 6/1993 | Kendall | 29/897.312 |
| 5,379,518 | A | * | 1/1995 | Hopper | 29/897.312 |
| 5,549,789 | A | * | 8/1996 | Atalla et al. | 162/65 |
| 5,570,548 | A | * | 11/1996 | Hopper | 52/204.5 |

FOREIGN PATENT DOCUMENTS

| | | | |
|---|---|---|---|
| DE | 29 09 425 | | 9/1980 |
| JP | 07292927 | A * | 11/1995 |

* cited by examiner

*Primary Examiner*—Jeanette Chapman
(74) *Attorney, Agent, or Firm*—Young & Thompson

(57) ABSTRACT

A thermally insulated frame member includes first and second elongate frame components (10, 12), an elongate thermally insulating material bridge component (14) securing the first and second elongate frame components (10, 12) to one another to define an elongate open channel, and a resin material (22) located within the channel.

10 Claims, 1 Drawing Sheet

Figure 1
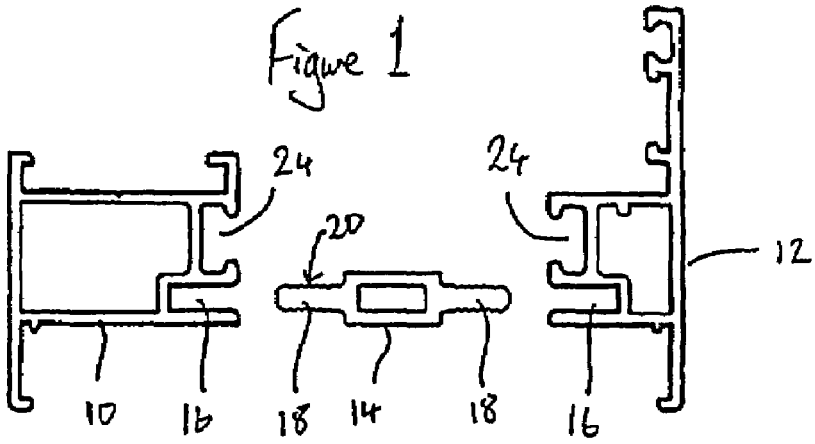
Figure 2
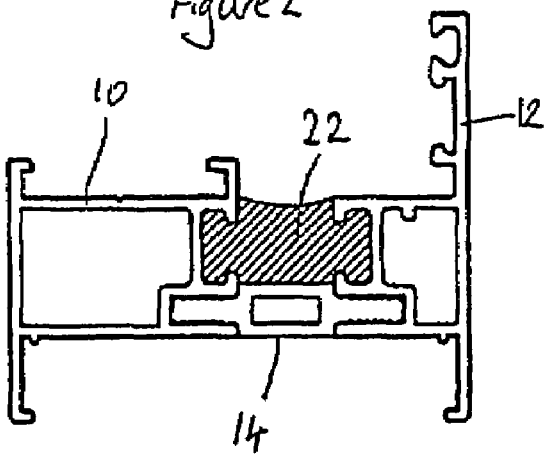
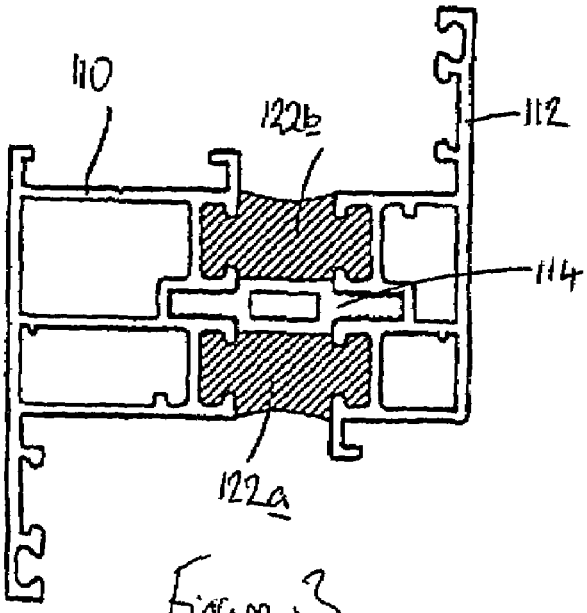
Figure 3

MANUFACTURE OF THERMALLY INSULATED FRAME MEMBERS

This invention relates to a method of manufacturing thermally insulated frame members, and to frame members manufactured according to the method.

A known technique for use in the manufacture of a thermally insulated frame member comprises taking a length of, typically, extruded aluminium of a chosen profile including a region of channel-shaped cross-section, filling the channel-shaped region with a settable resin material and allowing the resin material to set. The part of the profile forming the base of the channel is then cut away, typically using a milling technique, to leave two separate parts of the original profile connected to one another only by the resin material. The resin material forms a thermal break in the frame member.

New building regulations, and in particular a building regulation known as Document L, demand improvements in the thermal insulating properties of certain building products. In order to comply with these regulations it is thought to be necessary to increase the width of the resin filled channel. Although existing production equipment can be used to supply the resin to a channel of increased width, most existing equipment is not capable of removing the base of a channel of increased width.

By way of example, in order to comply with the regulations it is thought to be necessary to remove approximately 12 mm of material from the base of the channel whereas previously it was only necessary to remove 4-5 mm. The removal of such an increased width requires the use of a wider milling blade which, in turn, will often require the use of equipment of increased power. Further, the removal and disposal of aluminium forming a 12 mm bridge is inefficient.

Other techniques are known for providing a thermal break in an aluminium profile. For example, it is known to connect two parts of a profile to one another using polyamide bridge pieces to form an elongate closed passage The technique involves deforming the profile to secure the bridge pieces in position. This technique is relatively expensive to use and is relatively complex as the bridge pieces need to be accurately and securely mounted in position.

It is an object of the invention to provide a thermally insulated frame member and a method of manufacture thereof of relatively simple convenient form.

According to the present invention there is provided a thermally insulated frame member comprising first and second elongate frame components, an elongate thermally insulating material bridge component securing the first and second elongate frame components to one another to define an elongate open channel, and a resin material located within the channel. The thermally insulating material is conveniently a plastics material.

The parts of the first and second elongate frame components which define, in part, the channel are conveniently shaped to interlock with the resin material.

The bridge component and the first and second frame components are conveniently designed to be push-fitted to one another, but could alternatively be designed to be snap-fitted, interference fitted or otherwise mounted upon one another.

The first and second frame components are conveniently of extruded aluminium form. At least one, and preferably both components conveniently include a region of hollow section.

The bridge component is preferably of dimensions sufficient to ensure that the first and second frame components are spaced apart from one another by a distance of at least 12 mm. In order to minimize the quantity of material used in the bridge component and improve its thermal insulating properties, the bridge component is conveniently hollow and may take, for example, the form of an extruded element.

The invention also relates to a method of manufacture of such a frame member comprising securing two frame components together using an elongate thermally insulating material bridge component such that the frame components and the bridge component together define an open channel, supplying a settable resin to the channel and causing or allowing the resin to set.

The invention will further be described, by way of example, with reference to the accompanying drawings, in which:

FIG. 1 is an exploded sectional view of part of a frame member in accordance with an embodiment of the invention;

FIG. 2 is a sectional view of the assembled frame member; and

FIG. 3 is a view similar to FIG. 2 of another embodiment.

FIGS. 1 and 2 illustrate a thermally insulated frame member which comprises first and second elongate frame components 10, 12 of extruded aluminium form, each of which include a region of hollow section, and an elongate plastics bridge component 14. The elongate frame components 10, 12 each define a recess 16 shaped to receive part of a corresponding projection 18 of the bridge component 14. The projections 18 of the bridge component 14 are provided with serrations 20 to assist in push fitting the bridge component 14 to each of the frame components 10, 12, and to resist removal of the bridge component 14 therefrom.

Once assembled, the bridge component 14 rigidly secures the first and second frame components 10, 12 to one another, allowing relatively long sections to be manufactured without the use of complex jigs or other specialist support devices. The dimensions of the bridge component 14 are such that the frame components 10, 12 can be spaced apart from one another by a distance of 12 mm or more.

As shown in FIG. 2, when assembled, the first and second frame components 10, 12 and the bridge component 14 together define a channel which is filled with a resin 22, for example polyurethane resin.

As shown in the drawings, the parts of the first and second frame components 10, 12 which, in use, define, in part, the channel are shaped to define re-entrant regions 24. As shown in FIG. 2, the resin 22 extends into the regions 24, and the re-entrant nature of the regions 24 results in the formation of a mechanical interlock between the frame components 10, 12 and the resin 22 thereby further assisting in ensuring that the first and second frame components 10, 12 are firmly secured to one another.

A frame member of this construction is advantageous in that the resin 22 and bridge component 14 are both of reasonably good thermal insulating properties, and so form a thermal break between the first frame component 10 and the second frame component 12. The thermal insulating properties may be enhanced by the use of a bridge component 14 of hollow section, as shown. The thermal insulating properties are sufficiently good that a frame member of this construction can meet the current building regulations. Further, it will be appreciated that, if desired, the width of the channel could easily be increased simply by exchanging the bridge component with a bridge component of different dimensions, thereby allowing a further improvement in the thermal insulating properties of the frame member.

Another advantage of the frame member shown in the accompanying drawings is that there is no necessity to use the same colour or finish of material for the first and second frame components 10, 12.

The bridge component 14 illustrated in the accompanying drawings is of hollow form. It is thought that the provision of such a hollow bridge component may assist in achieving the required thermal insulating properties. The hollow nature further results in the bridge component 14 being relatively light weight and relatively cheap to produce as relatively little material is used in the component.

The method used to assemble the thermally insulated frame member simply comprises assembling the first and second frame components 10, 12 to the bridge component 14, and injecting or pouring the resin 22 into the channel defined by the first and second frame components 10, 12 and the bridge component 14. After the resin 22 has been introduced into the channel, the resin 22 is caused or allowed to set to rigidly secure the first and second frame components 10, 12 to one another. Unlike the traditional technique in which a milling operation is used to remove part of the aluminum profile, in the arrangement of the present invention, the bridge component 14 is left in position thereby simplifying the manufacturing process.

FIG. 3 illustrates the use of the technique with different section frame components. In the arrangement shown in FIG. 3, the frame components 10, 112 are secured to one another by a bridge component 114 to define two channels. Resin 122*a* is poured into one of the channels and allowed to set. The assembly is then inverted to allow resin 122*b* to be poured into the other channel and allowed to set.

It will be appreciated that the invention is not restricted to the specific profiles illustrated in the accompanying drawings, and that the invention is applicable to a wide range of profiles. Likewise, other changes could be made, for example the bridge component and frame components may be designed to be snap-fitted to one another.

The invention claimed is:

1. A thermal insulated frame member comprising first and second elongate frame components, an elongate thermally insulating material bridge component rigidly securing the first and second elongate frame components to one another to define an elongate open channel extending continuously between the first and second elongated frame components, and a resin material located and cured in situ within the channel and extending across the full length of the channel, the bridge component and the first and second frame components being adapted to be push fitted to one another, the bridge component being of hollow form and having projections formed thereon adapted to be received within corresponding recesses provided in the first and second frame components to secure the frame components to one another.

2. The frame member according to claim 1, wherein the thermally insulating material is a plastics material.

3. The frame member according to claim 1, wherein the parts of the first and second elongate frame components which define, in part, the channel are shaped to interlock with the resin material.

4. The frame member according to claim 1, wherein the first and second frame components are of extruded aluminium form.

5. The frame member according to claim 1, wherein at least one of the frame components includes a region of hollow cross-section.

6. The frame member according to claim 1, wherein the bridge component is of hollow cross-section.

7. The frame member according to claim 1, wherein the bridge component is adapted to space the frame components apart from one another by a distance of at least 12 mm.

8. The frame member according to claim 1, wherein the bridge component defines two channels.

9. The method of manufacture of a thermally insulated frame member comprising securing rigidly two frame components together using an elongate thermally insulating material bridge component such that the frame components and the bridge component together define an open channel extending continuously between the frame components, the frame components and the bridge component being adapted to be push fitted to one another, the bridge component being of hollow form and having projections formed thereon adapted to be received within corresponding recesses provided in the first and second frame components to secure the frame components to one another, and supplying a settable resin to the channel and causing or allowing the resin to set in situ, the resin material extending across the full width of the channel.

10. The method according to claim 9, wherein the bridge component is of a plastics material.

* * * * *